US005113851A

United States Patent [19]

Gamba

[11] Patent Number: 5,113,851

[45] Date of Patent: May 19, 1992

[54] CHAIR EQUIPPED WITH A SINGING SEAT

[76] Inventor: Eugenio Gamba, Via Londonio 12, Milano, Italy

[21] Appl. No.: 487,538

[22] Filed: Mar. 1, 1990

[51] Int. Cl.[5] ..... A01H 1/00

[52] U.S. Cl. ..... 128/33; 128/24 R; 128/45; 297/330

[58] Field of Search ..... 128/33, 35, 36, 51, 128/61, 24 R, 52, 45; 297/273, 85, 294, 322, 330, 335, 83

[56] References Cited

U.S. PATENT DOCUMENTS 2,707,465 5/1955 Nemeth ..... 128/33 X
3,191,594 6/1965 Bagnell ..... 128/24 R
3,667,453 6/1972 Schenck ..... 128/24 R
3,824,991 7/1974 Whitaker ..... 128/33

*Primary Examiner*—Robert A. Hafer
*Assistant Examiner*—David J. Kenealy
*Attorney, Agent, or Firm*—Horst M. Kasper

[57] ABSTRACT

A chair, comprising a chair seat which automatically and continuously swings in such a way as to change the position of the body of the seated person. As compared with the known chairs, the chair of the present invention has the advantage of breaking or interrupting the body immobility and the rigidity of muscles. The regular and continuous swinging movement of the chair seat induces the back to move and the muscles of the vertebral column to work. Circulatory activity is thus enhanced and the consciousness of the vertebral column is increased in the seated position of the body.

24 Claims, 5 Drawing Sheets

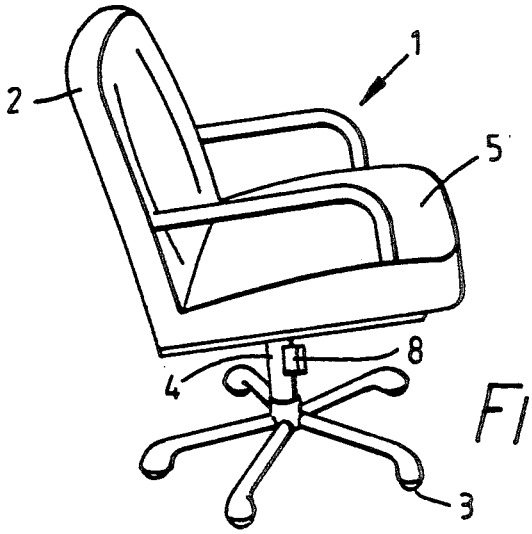
FIG. 1
FIG. 2
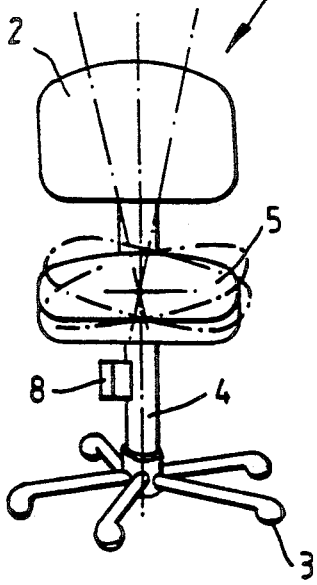
FIG. 3
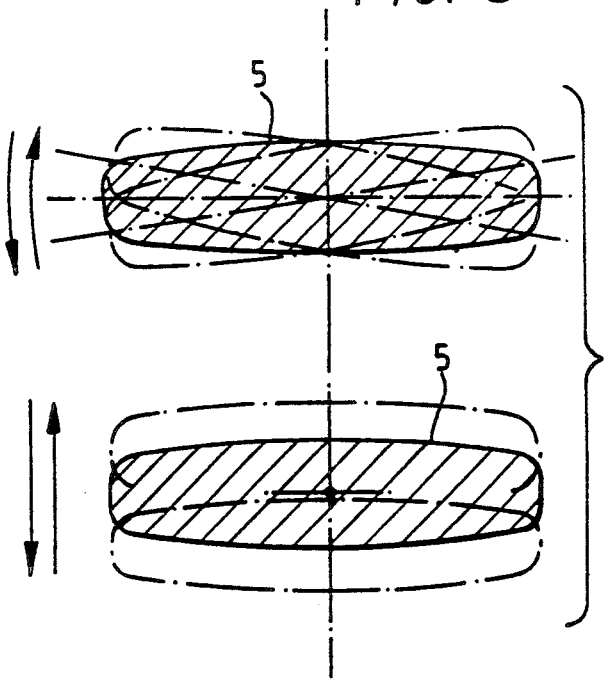

2
15
19
17
27
4
40
16
18
10
16

CHAIR EQUIPPED WITH A SINGING SEAT

BACKGROUND OF THE INVENTION

1. Field of the Invention

The present invention relates to a chair provided with a swinging seat, particularly adapted for the therapy and prevention of the rachialgia.

2. Brief Description of the Background of the Invention Including Prior Art

The human body, when seated on a chair, often assumes wrong and rigid positions, and maintains said positions for a long time. As a consequence of these wrong positions, the human body suffers rachialgia or vertebral pains, which are caused by the static structure of the known chairs.

SUMMARY OF THE INVENTION

1. Purpose of the Invention

The main purpose of the present invention is to overcome the above limits and drawbacks of the known chairs.

A particular object of the present invention is to apply the "dynamic ergonomics" concept to the therapy of the rachialgia in the specific field of chairs, easy chairs, armchairs, small-size armchairs and the like.

These and other objects and advantages of the present invention will become evident from the description which follows.

2. Brief Description of the Invention

The present invention provides for a chair comprising a chair seat which automatically and continuously tilts and oscillates in such a way as to change the position of the body of the person seated on the chair, thereby breaking the immobility and rigidity of the body. According to further characteristics of the chair of the present invention, means are provided for actively and continuously tilting and oscillating the chair seat at least when a person is seated on the chair. Said means consists of a joint for the connection of said seat on the support shaft of the chair and motor means to automatically and continuously swing, tilt, and oscillate the chair seat.

A rotating plane of the chair of the invention is driven by said motor means and is suitable to support and swing the seat of the chair by means of sliding support wheels or bearings, provided fastened on said rotating plane. Said seat is supported on said wheels or bearings.

One extremity of the shaft of the base of the chair of the present invention is engaged with the seat and is provided with a joint consisting of a round head secured to the seat. Said head is lodged within a corresponding housing provided on said extremity of the shaft.

Said rotating plane of the chair of the invention is secured on a rotating collar of the supporting shaft of the chair. A pinion and a gear are provided to transmit the rotation movement from the motor means to the rotating plane.

According to the characteristics of a preferred embodiment of the chair of the invention, a center plate, having a tapered section, is rotatably mounted between a lower fixed support plane and an upper swinging plane which supports the seat. Said center plate has a toothed inner edge and balls which are slidingly housed within annular grooves to rotatably support said center plane on the lower fixed plane and said upper plane on the center plate.

According to further characteristics of the chair of the invention, a stem is further provided to link the swinging plane to the fixed plane. The upper end of said stem comprises a ball joint lodged within a corresponding hollow housing of said swinging plane. A ball support is further mounted at the lower end of said stem. A housing for this ball support is provided on the lower fixed plane of the chair. A spring is mounted abutting against a small dish and a pin of said lower end of the stem. Said spring is housed within a collar secured to the support shaft of the chair. A bush is provided to fasten a microswitch on said collar.

The chair of the invention is also characterized in that a base is provided to support the lower plane—center plate—upper plane mechanism. Said base is mounted axially slidable on said collar under the action of said spring.

The base of the chair of the present invention comprises a hollow central body defining a housing, wherein said collar is slidingly housed. Said base also comprises a chamber, wherein motor means for driving said center plate are provided, and plates to support the backrest and the armrests of the chair.

According to another characteristic of the chair of the invention, a pin is secured to the swinging plane. Said pin is adapted to interfere with said microswitch when a person is seated on the chair, to actuate said motor means and to rotate said center plate.

As compared with the known chairs, the chair of the present invention has the advantage of breaking or interrupting the immobility and the rigidity of muscles and articulations of the body.

The regular and continuous tilting and oscillating movement of the chair seat, while not impairing the person seated on the chair, induces the pelvis to move and the muscles of the vertebral column to work. The circulatory activity is thus enhanced and the consciousness of the vertebral column is increased also in the seated position of the body.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

In the accompanying drawings, in which are shown several of the various possible embodiments of the present invention:

FIG. 1 illustrates a first embodiment of the chair of the invention;

FIG. 2 illustrates a second embodiment of the chair of the invention;

FIG. 3 shows some of the elementary movements of the chair seat of the chair of the invention;

DESCRIPTION OF INVENTION AND PREFERRED EMBODIMENT

The chair FIG. 1 is an armchair and FIG. 2 shows a small-sized chair of the type used in offices, laboratories, and the like. The field of the present invention should not in any case be restricted to any particular kind of chair.

Both of the embodiments of the chair of FIG. 1 and 2 comprise a chair seat 5 which automatically and continuously oscillates or swings, a few positions of the movement of the seat being illustrated by dashed lines in FIG. 2.

The width of these movements is obviously very restricted to avoid impairing the person seated on the chair. For the same reason, the oscillation movements are also very slow. In any case, the person seated on the chair is obliged to move his pelvis, thus breaking the immobility and stiffness of the body.

The tilting and oscillating movement of the seat 5 is formed of combined elementary side and front oscillation movements, some of these movements being shown in FIG. 3. The tilting and oscillating swing movement of the seat 5 is automatic and it continuously and regularly changes the inclination of the same chair seat in all directions. Some of these movements are shown by dashed lines in FIG. 4.

Figure 5:
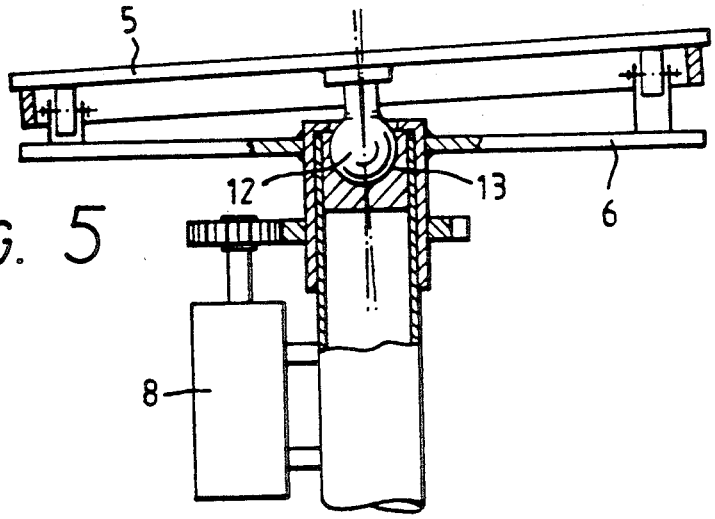
FIG. 5 is a vertical section of the support base of the chair seat of the invention.
Figure 6:
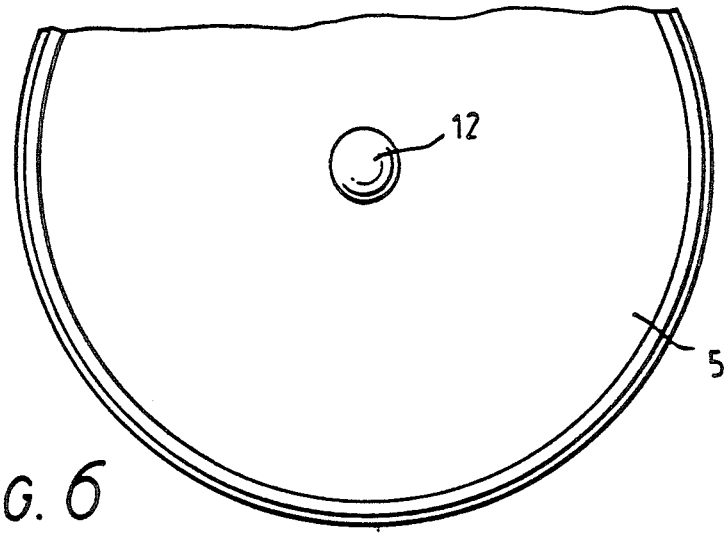
FIG. 6 is a view from the bottom, of the chair seat of FIG. 5.
Figure 7:
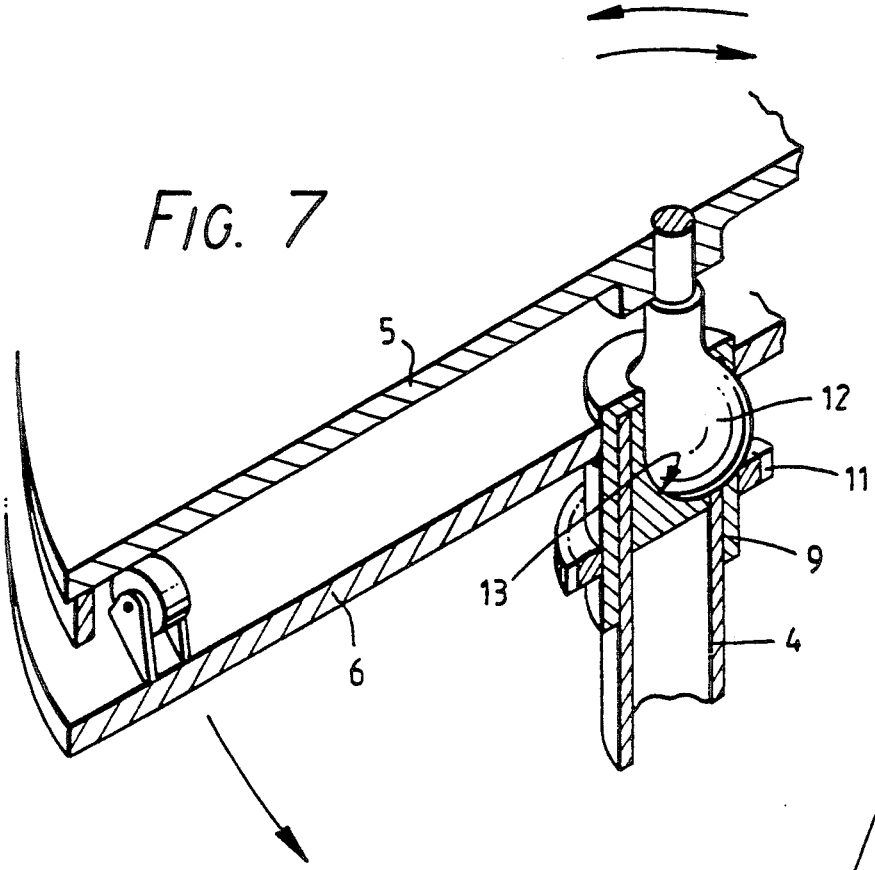
FIG. 7 is a section of the articulated joint of the chair seat of FIG. 5.

The above described movements of the seat 5 are allowed by means of the ball joint of FIGS. 5 and 7. This articulated joint consists of a round head 12 fastened to the center of the seat 5. The round head 12 engages itself within a corresponding housing 13 provided on the upper end of the shaft 4 of the base of the chair 1.

Figure 4:
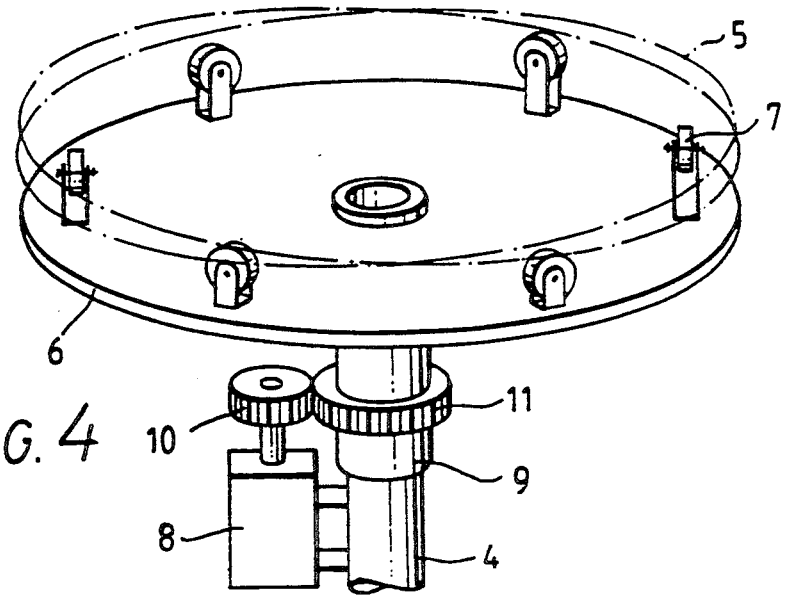
FIG. 4 is a view of the driving means of the chair seat of FIG. 3.

The chair seat 5 is swung by means of a lower support plane 6, also mounted on the shaft 4. The support 6 substantially consists of a plane similar to the seat 5, the upper surface of this support 6 facing the oscillating seat 5 and being provided with balls, ball-bearings or small wheels 7. The diameter of adjacent wheels gradually varies or, as it is illustrated in FIG. 4, the wheels are mounted at a gradually decreasing height at the periphery of the support 6.

As it is shown in the FIGS. 5 and 7, the small wheels 7 support the seat 5 on the lower support plane 6. When the chair 1 is not in use, the plane 6 stands still and the seat 5, supported on the wheels 7, is inclined as it is shown in FIG. 5.

When in use, the support 6 of the chair 1 regularly and continuously rotates along the axis of the shaft 4. For this purpose, the support 6 is mounted on the shaft 4 by means of a collar 9, and it is driven by electric motor means 8, a pinion 10, and a gear 11 (FIGS. 4 and 5).

The above described rotation of the support 6 causes the small wheels 7 to run on the lower surface of the seat 5. The position of the latter is thus gradually and continuously changed, as a result of the different height of the wheels on the plane 6.

To avoid a transmission of the rotation of the support 6 to the seat 5, the section of the head 12 can be elliptical, or different locking means (not shown) may be provided to allow the oscillating movements of the seat only.

Instead of the wheel-equipped support 6, other equivalent means can be used to change the inclination of the seat 5. The ball joint 12 can be substituted by any other different means adapted to allow the oscillating movements of the seat 5 and to avoid that the latter rotates. The driving means can also be directly mounted on the bottom of the seat, or hidden within the base thereof.

Figure 8:
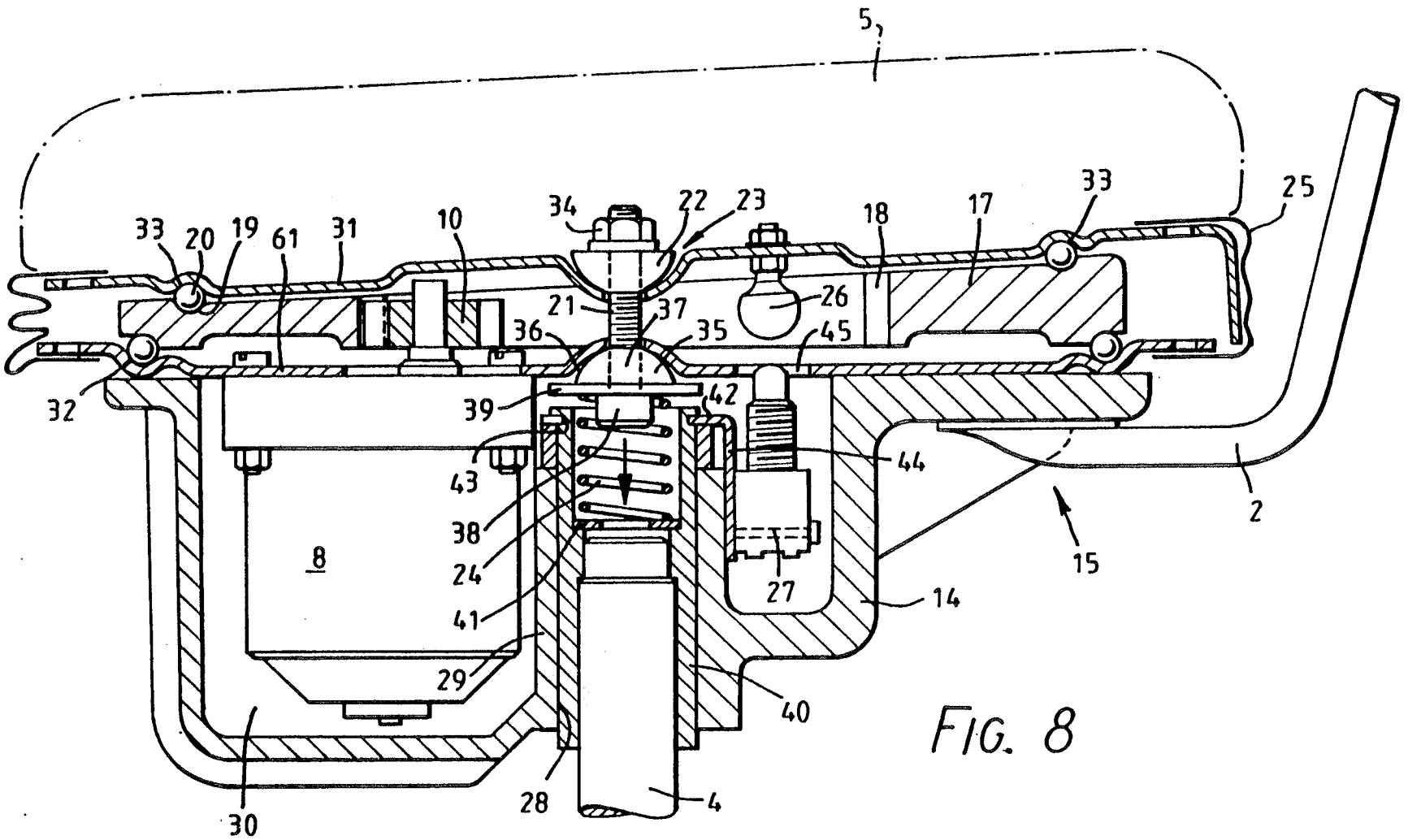
FIG. 8 is a view of a first embodiment of the chair seat of the present invention.
Figure 10:
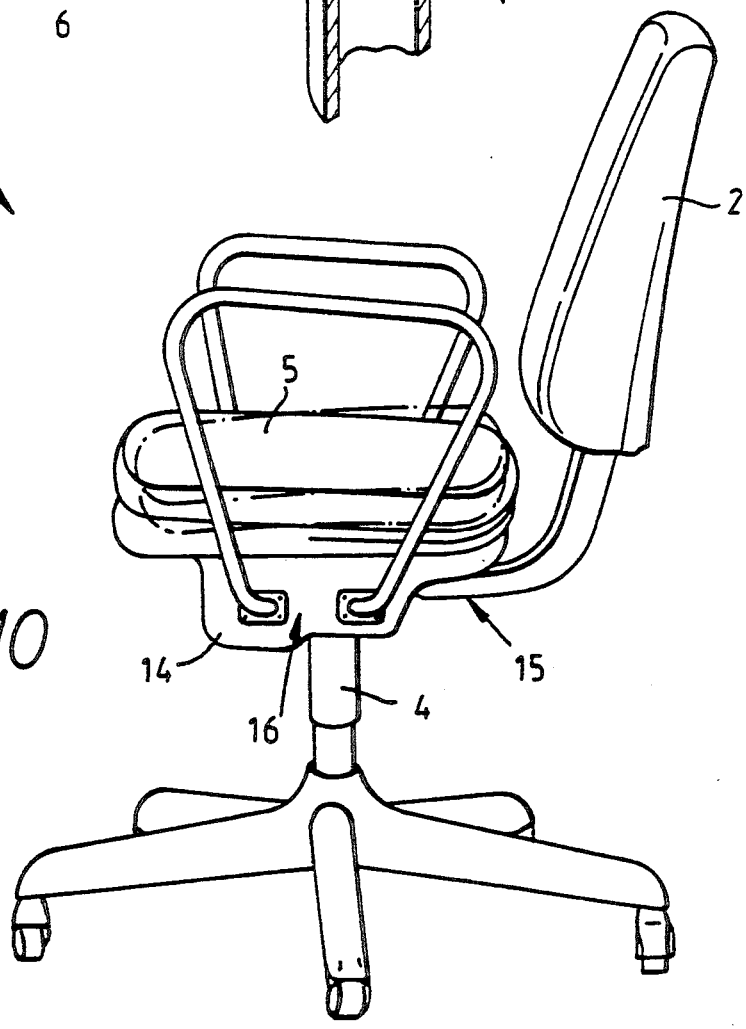
FIG. 10 is a view of a third embodiment of the chair seat of the present invention.
Figure 9:
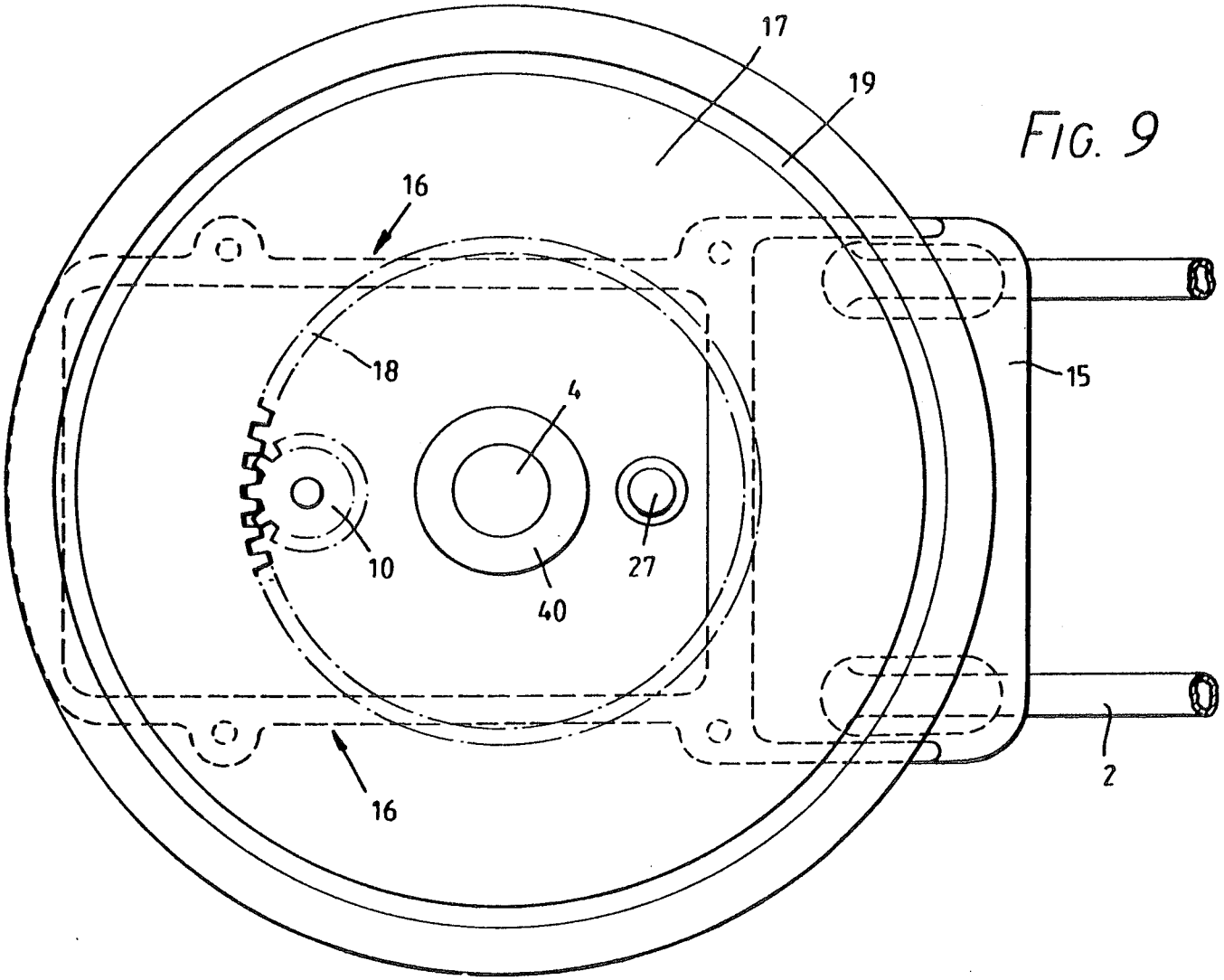
FIG. 9 is a view of a second embodiment of the chair seat of the present invention.

In the embodiment of FIGS. 8 to 10, a lower fixed support plane 61 is provided. Instead of the small wheels 7 of the preceding solution, a rotating thrust bearing or center plate 17 is mounted between the fixed support 61 and the swinging support 31 of the chair seat 5. The center plate 17 consists of a flat annular body having a tapered section or a trapezoidal profile. The center plate 17 is driven to rotate along the axis of the shaft 4 of the chair by means of a pinion 10 which meshes the toothed inner edge 18 of the center plate 17. The pinion 10 is in its turn driven by an electric motor 8 housed within a chamber 30 provided in the base 14 of the chair (FIG. 8).

The center plate 17 is rotatably supported by the lower plane 61 and supports in its turn the upper support plane 31 of the swinging chair seat 5. The center plate 17 thus rotates relative to the fixed plane 61 and the swinging support 31.

For this purpose, balls 20 are housed within two annular grooves 19, provided at opposing surfaces of the center plate 17, and within corresponding annular grooves 32, 33 of the plane 61 and the support 31, respectively.

The oscillating support 31 is hingedly joined to the center plate 17 and the lower plane 61 by means of a threaded stem 21. The upper end of this stem comprises a ball joint 22 housed within a corresponding hollow housing 23 of the support 31. A nut 34 is provided to tighten the ball joint 22 within the housing 23. A sufficient joint clearance is left to allow the support 31 to swing with respect to the stem 21 of the base of the chair. The opposite end 37 of the stem 21 is provided with a ball support 35 lodged within a housing 36 of the lower plane 61. This end 37 of the stem 21 extends downwards towards the shaft 4 of the chair, thus forming a lower pin 38. The latter is in turn provided with a small dish 39, against which the upper end of a spring 24 abuts.

As it is better shown in FIG. 8, the lower plane 61 is supported on a base 14 of the chair. Said base comprises a hollow central body 29 that creates a corresponding housing 28. Within this housing 28, a tubular element or collar 40 is slidably housed. Said collar is fixedly mounted on the shaft 4 of the chair. A washer 41 is disposed within the collar 40. The lower end of the spring 24 abuts against said washer 41. The opposite end of the same spring 24 is retained by the small dish 39 and the pin 38.

The base 14 and the plane 61 fixed on the base 14 are thus supported by the spring 24, and they are lowered or raised based on the action of the spring 24 depending on whether a person is seated on the chair. When the base 14 moves upwards or downwards, the central hollow body 29 slides along the collar 40, this latter being secured to the shaft 4.

As a matter of fact, the support plane 31 transmits the weight of the person seated on the chair to the spring 24. Said spring is then pressed in the direction of the arrow of FIG. 8. During this movement of the spring 24, the base 14 axially slides downwards along the fixed collar 40. When the person seated on the chair gets up from the invention chair, the elastic reaction of the spring 24 causes the opposite movement of the base 14.

A microswitch 27, adapted to actuate the motor 8, is fixedly mounted to the collar 40 by means of a bush 44. The bush 44 is in turn joined to the collar 40 by means of the folded edge 42 of the bush 44, which is locked into a corresponding hollow annular housing 43 of the upper end of the collar 40.

The microswitch 27 is mounted aligned with respect to a pin 26 secured to the lower surface of the support 31 of the seat 5. An opening 45 of the lower plane 61 allows the pin 26 to continuously touch the microswitch 27 when the spring 24 is pressed under the weight of a person seated on the chair.

When a person sits on the invention chair, the rotation of the center plate 17 is automatically started. As a matter of fact, the weight of the person seated on the chair flattens the spring 24, and the base 14 slides downwards along the shaft 4. The descent of the base 14 causes the pin 26 to strike the microswitch 27. The microswitch 27 is fixedly mounted with respect to the pin 26, since the microswitch 27 is supported by the fixed collar 40. When the pin 26 acts against the microswitch 27, the motor 8 is started and the center plate 17 rotates. The relative distance of the pin 26 and the microswitch 27 is such that they touch each other when the support plane 31 swings and the person is seated on the chair. In contrast, when the person rises from the chair, the spring 24 lifts the base 14 and the bearing 17 rotates until the inclination of the plane 31 is sufficient to separate the pin 26 from the microswitch 27. The motor 8 thus stops the seat 5 in its stand-by position.

In the embodiment of FIG. 8, only the seat 5 tilts and oscillates, whereas the lower plane 61 and the base 14 stand still.

The base 14 is also provided with a plate 15 for supporting the backrest of the chair, and side plates 16 to support the armrests of the chair of the invention (FIGS. 9 and 10). This structure of the chair of the invention results in that the movements of the seat 5 are not transmitted to the backrest and armrests of the chair. Thus, these parts remain permanently still when the chair is used.

The peripheral edge of the mechanism formed of the lower support plane 61, the center plate 17, and the support 31 of the seat 5, is covered by a strong and elastic cover material 25. The latter is fastened to the periphery of the support planes 61 and 31 by means of clamps, screws and the like. The movements of the chair seat 5 is not hindered by the presence of the cover 25.

When the seat 5 of the chair of the invention tilts and oscillates, the person seated on the chair must move his pelvis to reach the new balance positions, thus breaking the rigidity of the body. The active work of the vertebral articulations is then carried out, the circulatory activity is increased, and the person has the consciousness of his body also in the seated position.

It will be understood that each of the elements described above, or two or more together, may also find a useful application in other types of chairs differing from the types described above.

While the invention has been illustrated and described as embodied in the context of a chair equipped with a swinging seat chair, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A chair comprising a support shaft;

a backrest attached to the support shaft and stationary relative to the support shaft;

a spring (24) is mounted to the upper end of the support shaft;

a ball joint connected to the support shaft at an upper end of the support shaft via the spring for providing an elastic support to a ball bearing;

a chair seat (5), which is hingedly mounted on the ball bearing and wherein the tilting and oscillating of said chair seat is performed relative to the stationary backrest;

tilting means attached to the support shaft and engaging the chair seat (5) for swingingly supporting said seat (5);

motor means for furnishing momentum to the tilting means thereby forming a dynamic assembly for actively tilting and oscillating the chair seat in such as way as to change the position of the pelvis of a person seated on the chair and to induce a corresponding vertebral movement of compensation, the immobility and rigidity of the vertebral column of the person seated on the chair seat (5) being thus broken.

2. A chair as claimed in claim 1, wherein said means consist of a joint (12, 13) for the connection of said chair seat (5) on the support-shaft (4) of the chair, motor means (8) being further provided for automatically and continuously swinging the chair seat (5).

3. A chair as claimed in claim 2, wherein a lower rotating support plane (6) is driven by said motor means (8), said lower rotating support plane (6) being suitable to support and swing the chair seat (5) of the chair.

4. A chair as claimed in claim 3, wherein said lower rotating support plane (6) comprises sliding means to slidingly support and swing the chair seat (5) on different height levels relative to an upper surface of the chair seat (5); and wherein said sliding mans consist of support revolving means fastened to said rotating plane (6), the seat (5) being supported on said means.

5. A chair as claimed in claim 4, wherein the chair seat (5) includes a base (14), and wherein one extremity of the support shaft (4) of the base (14) of the chair is engaged with the chair seat (5) and is provided with a joint (12, 13) consisting of a joint head (12) secured to the chair seat (5), the joint head (12) being lodged within a corresponding joint housing (13) provided on said extremity of the support shaft (4).

6. A chair as claimed in claim 5, wherein said support plane (6) is secured on a rotating collar (9) of the support shaft (4) of the chair, a pinion (10) and a gear (11) being provided to transmit the rotation movement from the motor means (8) to the lower rotating support plane (6).

7. A chair as claimed in claim 1 wherein said tilting means consist of a center plate (17) having a tapered section.

8. A chair as claimed in claim 7, wherein said center plate (17) is rotatably mounted between a lower fixed support plane (61) and an upper swinging support plane (31) supporting the chair seat (5) of the chair.

9. A chair as claimed in claim 8, wherein said center plate (17) has a toothed inner edge (18) and balls (20) which are slidingly housed in annular grooves (19) to rotatably support said center plate (17) on the lower fixed support plane (61), and said upper swinging support plane (31) on the center plate (17).

10. A chair as claimed in claim 9, wherein a stem (21) is further provided to link the upper swinging support plane (31) to the lower fixed support plane (61), an upper end of said stem (21) comprising a ball joint (22) lodged within a corresponding hollow housing (23) of said upper swinging plane (31).

11. A chair comprising a dynamic assembly for actively tilting and oscillating a chair seat (5) which is hingedly mounted on a support shaft (4) in such a way as to change the position of the pelvis of a person seated on the chair and to induce a corresponding vertebral movement of compensation, the immobility and rigidity of the vertebral column of the person seated on the chair seat (5) being thus broken;

wherein said tilting means consist of a center plate (17) having a tapered section;

wherein said center plate (17) is rotatably mounted between a lower fixed support plane (61) and an upper swinging support plane (31) supporting the chair seat (5) of the chair;

wherein said center plate (17) has a toothed inner edge (18) and balls (20) which are slidingly housed in annular grooves (19) to rotatably support said center plate (17) on the lower fixed support plane (61), and said upper swinging support plane (31) on the center plate (17);

wherein a stem (21) is further provided to link the upper swinging support plane (31) to the lower fixed support plane (61), an upper end of said stem (21) comprising a ball joint (22) lodged within a corresponding hollow housing (23) of said upper swinging plane (31);

wherein a ball support (35) is mounted at a lower end (37) of said stem (21), a housing (36) for this ball support (35) being provided on the lower fixed support plane (61), wherein the lower end (37) of said stem (21) extends downwards and forms a pin (38), wherein the pin (38) is provided with a small dish (39), and wherein a spring (24) is mounted to abut against the small dish (39).

12. A chair as claimed in claim 11, wherein said spring (24) is housed within a collar (40) secured to the support shaft (4) of the chair, a bush (44) being provided to fasten a microswitch (27) on said collar (40).

13. A chair as claimed in claim 12, wherein a base (14) is provided to support the lower fixed support plane (61) - center plate (17) - upper swinging support plane (31) mechanism, said base (14) being mounted axially slidable, under the action of said spring (24), on said collar (40).

14. A chair as claimed in claim 13, wherein said base (14) comprises a hollow central body (29) defining a housing (28), wherein said collar (40) is slidingly housed, said base (14) further comprising a chamber (30), wherein motor means (8) for driving said center plate (17) are provided, and a plate (15) to support a backrest (2) and side plates (16) to support armrests (2*a*) of the chair.

15. A chair as claimed in claim 14, wherein a pinion (10), driven by the motor means (8). engages with the toothed inner edge (18) of the center plate (17).

16. A chair as claimed in claim 15, wherein a pin (26) is secured to the upper swinging support plane (31), said pin (26) being adapted to interfere with said microswitch (27) of the motor means (8) when a person is seated on the chair.

17. A chair as claimed in claim 16, wherein said spring (24) is pressed due to the weight of the seated person, and wherein said pin (26) thereby acts against said microswitch (27) resulting in a rotation of said center plate (17).

18. A chair as claimed in claim 11, wherein an elastic cover material (25) is fastened to the edge of the lower fixed support plane (61) - center plate (17) - upper swinging support plane (31) mechanism.

19. The chair comprising a dynamic assembly for actively tilting and oscillating a chair seat (5) which is hingedly mounted on a support shaft (4) in such a way as to change the position of the pelvis of a person seated on the chair and to induce a corresponding vertebral movement of compensation, the immobility and rigidity of the vertebral column of the person seated on the chair seat (5) being thus broken;

a ball joint (12, 13) including a joint head (12) and a joint housing (13) centrally disposed on the chair seat (5);

a base (14) of the chair;

a support shaft (4) attached to and rising from the base (14) of the chair and having an upper end, wherein the joint housing (13) is attached to the upper end of the support shaft (4), matches the joint head (12) of the chair, and engages the joint head (12) of the chair;

a support shaft;

a backrest attached to the support shaft and stationary relative to the support shaft;

a spring (24) is mounted to the upper end of the support shaft;

a lower support rotating plane (6) mounted onto the shaft (4), wherein said lower support plane (6) has an upper surface facing the chair seat (5);

a collar (9) mounted on the support shaft (4) and supporting the lower rotating support plane (6);

electric motor means (8) having a motor shaft (8*a*);

a pinion (10) attached to the motor shaft (8*a*);

a gear (11) attached to the collar (9) and engaging the pinion (10) for continuously rotating the lower rotating support plane (6).

20. The chair according to claim 19, further comprising frictionless support members (7) disposed on the upper surface of the lower rotating support plane (6) facing the chair seat (5) for supporting said chair seat (5) on said lower rotating support plane, wherein the frictionless support members (7) have different height levels as compared to the level of the upper surface of the lower rotating support plane (6).

21. The chair comprising a dynamic assembly for actively tilting and oscillating a chair seat which is hingedly mounted on a support shaft in such a way as to change the position of the pelvis of a person seated on the chair and to induce a corresponding vertebral movement of compensation, the immobility and rigidity of the vertebral column of the person seated on the chair seat (5) being thus broken;

a support shaft (4) for supporting and positioning the chair;

a support shaft;

a backrest attached to the support shaft and stationary relative to the support shaft;

a spring (24) is mounted to the upper end of the support shaft;

a lower fixed support plane (61), furnished with an annular groove (32);

an upper swinging support plane (31) for the chair seat (5) furnished with an annular groove (33);

a center plate (17) having a toothed inner edge (18) and mounted between the lower fixed support plane (61) and the upper swinging support plane (31), wherein the center plate (17) is furnished on its opposed surfaces with annular grooves (19), and wherein the center plate (17) is rotatably supported by the lower fixed support plate (61) and is in turn supporting the upper swinging support plane (31);

a pinion (10) meshing the toothed inner edge (18) of the center plate (17);

an electric motor means (8) driving the pinion (10);

balls (20) housed in the annular grooves (19) of the center plate in the annular groove (32) of the lower fixed support plane (61), and in the annular groove (33) of the upper swinging support plane (31);

a threaded stem (21) having an upper end and joining the upper swinging support plane (31) to the center plate (17) and to the lower fixed support plane (61) and having a lower end toward the support shaft (4) thus forming a lower pin (38);

a ball joint (22) disposed at the upper end of the threaded stem (21);

a hollow housing (23) disposed in the upper swinging support plane (31) and surrounding the ball joint (22);

a ball support (35) furnished at a second end of the threaded stem (21).

22. The chair according to claim 21, further comprising a base (14) of the chair supporting the lower fixed support plane (61);

a hollow central body (29) creating a corresponding housing (28).

23. The chair according to claim 21, further comprising a bush (44) having a folded edge (42) and mounted to the collar (40) by the folded edge (42), wherein the folded edge (42) is locked into a corresponding hollow annular housing (43) of an upper end of the collar (40);

a microswitch (27), adapted to actuate the motor means (8) upon seating of a person, is mounted securedly to the collar (40) by way of the bush (44);

an opening (45) formed in the lower fixed support plane (61);

a pin (26) disposed on and attached to the upper swinging support plane (31) such that upon seating of a person, the pin (26) continuously presses onto the microswitch (27) for inducing a rotation of the center plate (17).

24. The chair according to claim 23, further comprising a plate (15) attached to the base (14) of the chair for supporting the backrest (2) of the chair;

side plates (16) attached to the base (14) of the chair for supporting arm rests (2*a*) of the chair such that movements of the chair seat (5) are not transmitted to the backrest (2) and arm rests (2*a*) of the chair;

a strong and elastic cover material (25), covering the center plate (17) and the upper swinging support plane (31), and wherein said strong and elastic cover material (25) is attached to the periphery of the upper swinging support plane (31) and to the periphery of the lower fixed support plane (61) without hindering the movements of the chair seat (5).

* * * * *

UNITED STATES PATENT AND TRADEMARK OFFICE

CERTIFICATE OF CORRECTION

PATENT NO. : 5,113,851

DATED : May 19, 1992

INVENTOR(S) : Eugenio Gamba

It is certified that error appears in the above-indentified patent and that said Letters Patent is hereby corrected as shown below:

Title page under [54] delete "SINGING SEAT" and substitute therefor --SWINGING SEAT CHAIR--.

Column 1, line 1 delete "SINGING SEAT" and substitute therfor --SWINGING SEAT CHAIR--.

Signed and Sealed this

Fifth Day of October, 1993

*Attest:*

*Attesting Officer*

BRUCE LEHMAN

*Commissioner of Patents and Trademarks*